United States Patent [19]

Goodall et al.

[11] Patent Number: 4,839,100

[45] Date of Patent: Jun. 13, 1989

[54] DECONTAMINATION OF SURFACES

[75] Inventors: George H. Goodall, Merseyside, England; Barry E. Gillespie, Sychdyn NR Mold, Wales

[73] Assignee: British Nuclear Fuels PLC, Warrington, England

[21] Appl. No.: 49,573

[22] Filed: May 14, 1987

[30] Foreign Application Priority Data

Jun. 4, 1986 [GB] United Kingdom ..... 8613522

[51] Int. Cl.[4] ..... G21F 9/00; C23G 1/02; B08B 9/00; G21C 19/42

[52] U.S. Cl. ..... 252/626; 134/2; 134/3; 134/8; 134/22.14; 134/22.19; 134/28; 134/41; 376/309; 376/310

[58] Field of Search ..... 423/11, 18, 15, 20; 252/631, 626; 134/3, 1, 2, 22.13, 7, 8, 22.14, 22.19, 26, 28, 29, 41; 376/309, 310, 313

[56] References Cited

U.S. PATENT DOCUMENTS

| | | | |
|---|---|---|---|
| 2,981,643 | 4/1961 | Baybarz | 134/3 |
| 3,496,017 | 2/1970 | Weed | 134/2 |
| 3,664,870 | 5/1972 | Oberhofer et al. | 134/3 |
| 3,873,362 | 3/1975 | Mihram et al. | 134/3 |
| 4,042,455 | 8/1977 | Brown | 252/626 |
| 4,226,640 | 10/1980 | Bertholdt | 134/3 |
| 4,287,002 | 6/1980 | Torok | 134/3 |
| 4,512,921 | 4/1985 | Anstine et al. | 252/626 |
| 4,681,705 | 7/1987 | Robertson | 252/631 |
| 4,705,573 | 11/1987 | Wood et al. | 134/3 |
| 4,729,855 | 3/1988 | Murray et al. | 252/626 |

FOREIGN PATENT DOCUMENTS 2440601 10/1979 France .

OTHER PUBLICATIONS

Margulies, Paul, 1955, Surface Treatment of Metals with Peroxygen Compounds, Plating, 42:561-566.

*Primary Examiner*—Howard J. Locker
*Attorney, Agent, or Firm*—William R. Hinds

[57] ABSTRACT

A process for removing radioactive species such as technetium from surfaces of components such as those formed from aluminum, and a process of treating the resulting effluents. For example, technetium trapped under an oxide layer present on an aluminum component is removed by removing the oxide layer with sulphuric acid, and treating the exposed technetium with a complexing agent such as citrate in the presence of an oxidizing agent. An oxide scavenger may be added to prevent reformation of the oxide layer. Actinides can be removed from the effluent by use of a chelating ion exchange material, and technetium by oxidation and use of a basic ion exchange material.

8 Claims, No Drawings

DECONTAMINATION OF SURFACES

BACKGROUND OF THE INVENTION

This invention relates to the decontamination of surfaces and particularly, but not exclusively, to the removal of technetium from surfaces of aluminum containing components.

Aluminum components used in nuclear plants, especially enrichment plants, become contaminated with, for example, uranium, neptunium and technetium$^{99}$. The bulk of the uranium and neptunium present on the surface of a component can be removed using a wet chemical route incorporating a chelating agent.

In the case of technetium, it is highly desirable to remove not only technetium on the surface of the component but also technetium bound under a layer of aluminium oxide present on the surface of the component. The presence of the oxide layer renders the trapped technetium inaccessible to the chemicals used to remove uranium from the surfaces of components. With technetium a further problem is encountered which is not encountered with uranium, in that a slight build up of technetium in the decontamination liquor results in some of the technetium plating back onto the surface. Consequently, the route used to remove uranium from the surfaces of components cannot be used to efficiently remove technetium from those surfaces.

Features and Aspects of the Invention

According to the present invention, there is provided a method of decontaminating a surface of a component containing aluminum contaminated with technetium trapped under an oxide layer present on the surface, said method comprising chemically treating the surface to remove the layer so as to expose the technetium, converting the exposed technetium into a soluble form in the presence of an oxide scavenger, and an oxidizing agent so as to substantially prevent reduction of the soluble form of the technetium to an insoluble form and hence prevent redeposition of the technetium on the surface.

The oxide scavenger is present to substantially prevent reformation of the oxide layer.

The component may comprise aluminum or the component may contain aluminum.

The technetium may comprise technetium per se or a derivative thereof, for example an oxide of technetium.

The radioactive species may be converted into a soluble form by treating with a complexing agent such as a citrate.

The oxidizing agent may be hydrogen peroxide, and the oxide scavenger may be sodium sulphate.

It is also preferred that the component is chemically treated to substantially remove the oxide layer with sulphuric acid, but other chemicals capable of removing the layer may be used, for example an alkaline solution containing sequestering agents such as citrate or phosphate.

The radioactive species can be removed from the liquor either continuously or batchwise. For example, technetium can be removed by percolating the liquor over a basic ion exchange resin. Similarly copper and other transition metals are removed by circulation of the liquor over a chelating resin. This prevents transition metals, present in most aluminum alloys, from building up and destroying the hydrogen peroxide.

It is believed that the problem of technetium plating back onto the surface being decontaminated is due to the reduction of a soluble pertechnate species ($TcO_4^-$) to an insoluble technetium species, such as technetium dioxide ($TcO_2$). When the component contains aluminum the reduction may be carried out by the aluminum itself.

It is thought that the technetium species e.g. $TcO_2$ on the surface of the component is converted into the soluble form by, for example, formation of a citrate complex and that the technetium in this complex is oxidized by the oxidizing agent to a species such as pertechnate ($TcO_4^-$). The citrate may not be bound to the technetium in the oxidized species ($TcO_4^-$). This oxidation prevents redeposition of technetium by virtue of an equilibrium between insoluble technetium such as $TcO_2$ and the soluble technetium complex and also prevents redeposition due to reduction of the oxidized technetium species back to an insoluble form such as $TcO_2$.

Also according to the present invention, there is provided a method of decontaminating a surface of a component containing aluminum contaminated with technetium trapped under an oxide layer present on the surface, comprising chemically treating the surface to remove the layer so as to expose the technetium, said chemical treating step comprising placing the component in a chemical treating tank containing a solution selected from the group consisting of solutions of sulphuric acid and alkaline solutions containing sequestering agents, and converting the exposed technetium into a soluble form in the presence of an oxidizing agent so as to substantially prevent reduction of the soluble form of the technetium to an insoluble form and hence prevent redeposition of the technetium on the surface, said converting step comprising placing the component in a liquid bath containing a mixture of a complexant for converting the technetium into a soluble form, an oxidant, and an oxide scavenger.

Since radioactive species trapped under an oxide layer are removed, the invention may be used to increase the decontamination efficiency of species whose bulk can be removed from surfaces by routes which do not remove trapped species. For example neptunium present on surfaces, but not that under an oxide layer, can be removed by conventional routes and the trapped neptunium can be removed by the method of this invention.

The present disclosure further provides a method of treating effluent containing actinides and technetium, said method comprising contacting the effluent with a chelating ion exchange material to substantially remove the actinides, and contacting the effluent with a basic ion exchange material to substantially remove the technetium.

Preferably, the technetium is in an oxidized form. The effluent may contain uranium, neptunium and technetium.

The effluent may comprise an acid such as sulphuric acid. It is preferable that the pH of the effluent is adjusted to pH 0.5 to 3 before the effluent is contacted with the basic ion exchange material.

The present disclosure also provides a method of treating the effluents resulting from the removal of uranium and technetium from components containing aluminium. Such method will become apparent from the ensuing description of a preferred embodiment.

Description of the Preferred Embodiment

The process is essentially a two bath system. In the first bath the surface is conditioned by removal of the aluminium oxide layer so as to expose the technetium contaminant. The second bath contains an oxidant, an oxide scavenger and a complexant to remove the exposed technetium.

To promote further understanding of the invention an embodiment will now be described by way of example only.

Contaminated components may be treated initially with a citric acid solution to remove uranium and neptunium present on the surfaces of the components. The components are then transferred to a wash water tank, which is held at a temperature of 50°-70° C., to prevent carry over of chemicals, uranium and neptunium. After this washing stage the components are placed in a tank containing a 1M to 3M solution of sulphuric acid held at 50° C. to 70° C. to remove the aluminum oxide and therefore expose the technetium. Alternatively a 0.1M alkaline solution containing sequestering agents such as citrate or phosphate can be used to remove the aluminum oxide layer. From this tank the components are firstly transferred to a wash water tank at ambient temperature and then to a bath containing a mixture of disodium citrate (0.05M to 0.2M), an oxidant, hydrogen peroxide (5 volumes to 20 volumes), and an oxide scavenger, sodium sulphate (0.05M to 0.2M), held at ambient temperature.

It is preferable to provide that the contaminated components are subjected to a second series of tanks identical to those described above except for the omission of a second citric acid tank. This further cleaning process is desirable to give a higher decontamination efficiency.

The liquor present in the bath containing disodium citrate, hydrogen peroxide and sodium sulphate is continually circulated over a chelating resin, such as AMBERLITE (RTM) IRC 718, to remove copper and other transition metals, and over a basic ion exchange resin, such as AMBERLITE (RTM) IRA 94S or IRA 402, to remove technetium. All these resins are manufactured by the Rohm and Haas Company. It is desirable to remove these transition metals since a build up would destroy the hydrogen peroxide. Alternatively, the use of a peroxide stabilizer in the solution such as "STABTABS" supplied by Interox Ltd can achieve the same result. Removal of technetium leads to a higher decontamination efficiency.

The effluent resulting from the decontamination process described above consists of four types:

a. Citric acid (0.33M) containing heavy metals, technetium, uranium and aluminium salts.

b. Sulphuric acid (2M) containing aluminum salts, technetium and traces of heavy metals, uranium and neptunium.

c. Disodium citrate (0.1M), hydrogen peroxide (10 volumes), sodium sulphate solution (0.1M) containing technetium, aluminum and traces of heavy metals.

d. Wash water containing traces of technetium.

These effluents can be treated in the following ways. The citric acid effluent is acidified to a pH in the range 0 to 1 by using sulphuric acid. Sodium persulphate is added to produce about a 1% solution. The liquor is then heated to 60° C.-90° C. and held at this temperature for 20 minutes to allow the technetium to oxidize. Depending on the temperature employed, a further period of up to 24 hours is required to destroy residual persulphate. The liquor is then cooled, and its pH adjusted to greater than 13 to precipitate uranium and neptunium as diuranate and dineptunate which is then removed using standard centrifuge methods. Finally the liquor is percolated over a basic ion exchange resin such as the said IRA 94S or IRA 402 to remove technetium 99. An alternative effluent processing scheme for the citric acid bath is to evaporate off the excess water in order to recover an active solid waste material.

Residual traces of uranium and neptunium may be removed from the sulphuric acid by percolating the untreated solution over a suitable chelating ion exchange resin such as Duolite ES 467 supplied by Rohn and Haas Ltd. Sodium persulphate in then added to the sulphuric acid effluent to produce about a 1% solution. The temperature of the liquor is then raised to 60°-90° C. and held at this temperature for 20 minutes. Up to 24 hours are needed to complete the destruction of excess persulphate. The cooled liquor may be treated without pH adjustment or is adjusted to pH 0.5 to 3 by addition of caustic liquor, solids are removed by filtration and then the liquor is percolated over a basic ion exchange resin, to remove technetium. Improved ion exchange utilisation is achieved at the higher pH. The resulting liquor is free of technetium$^{99}$ and can be safely released into the environment.

If the concentration of aluminum salts are high premature precipitation in the process liquor may occur. In order to prevent this, aluminum salts can be removed continually from solution by circulating the liquor through an acid purification unit such as an Eco-Tek (TM) unit marketed by Eco-Tec Ltd of Canada. The acidic liquor is then returned to the processing tank and upon final exhaustion is treated as described in the previous paragraph.

The disodium citrate solution is maintained low in technetium and transition metals by the use of on-line ion exchange resins during the decontamination process. Before disposal it is desirable to remove the hydrogen peroxide present in the effluent. This is achieved by percolating the liquor over activated charcoal at ambient temperature. Following this stage the liquor may be percolated over a basic ion exchange resin to remove any remaining traces of technetium before it is discharged into the environment.

Finally the wash water is usually so low in technetium, uranium, neptunium and heavy metals that it requires no further treatment.

Although the invention has been described in the context of removal of technetium from aluminum components, the invention may also be employed to decontaminate components made from other materials, such as mild steel and nickel, i.e. materials which may be used in other nuclear plants such as reprocessing plants.

We claim:

1. A method of decontaminating a surface of a component containing aluminum contaminated with technetium trapped under an oxide layer present on the surface, said method comprising chemically treating the surface to remove the layer so as to expose the technetium, converting the exposed technetium into a soluble form in the presence of an oxide scavenger and an oxidizing agent so as to substantially prevent reduction of the soluble form of the technetium to an insoluble form and hence prevent redeposition of the technetium on the surface.

2. A method as claimed in claim 1 in which the oxide scavenger comprises sodium sulphate.

3. A method as claimed in claim 1 in which the technetium is converted into the soluble form by treatment with a complexing agent.

4. A method as claimed in claim 3 in which the complexing agent is a citrate.

5. A method as claimed in claim 1 in which the surface is treated with sulphuric acid to remove the layer.

6. A method as claimed in claim 1 in which the oxidizing agent comprises hydrogen peroxide.

7. A method of decontaminating a surface of a component containing aluminum contaminated with technetium trapped under an oxide layer present on the surface, comprising chemically treating the surface to remove the layer so as to expose the technetium, said chemical treating step comprising placing the component in a chemical treating tank containing a solution selected from the group consisting of solutions of sulphuric acid and alkaline solutions containing sequestering agents, and converting the exposed technetium into a soluble form in the presence of an oxidizing agent so as to substantially prevent reduction of the soluble form of the technetium to an insoluble form and hence prevent redeposition of the technetium on the surface, said converting step comprising placing the component in a liquid bath containing a mixture of a complexant for converting the technetium into a soluble form, an oxidant, and an oxide scavenger.

8. A method as claimed in claim 7 wherein said sequestering agents are selected from the group consisting of citrate and phosphate, said oxidant is hydrogen peroxide, said oxide scavenger is sodium sulfate, and said complexant is disodium citrate.

* * * * *